US005287151A

United States Patent [19]

Sugiyama

[11] Patent Number: 5,287,151

[45] Date of Patent: Feb. 15, 1994

[54] DEVELOPING DEVICE FOR AN IMAGE FORMING APPARATUS USING A DRY DEVELOPER

[75] Inventor: Toshihiro Sugiyama, Yokohama, Japan

[73] Assignee: Ricoh Company, Ltd., Tokyo, Japan

[21] Appl. No.: 836,739

[22] Filed: Feb. 19, 1992

[30] Foreign Application Priority Data

Feb. 19, 1991 [JP] Japan ..... 3-45426
Oct. 30, 1991 [JP] Japan ..... 3-284571

[51] Int. Cl.[5] ..... G03G 15/06

[52] U.S. Cl. ..... 355/260; 355/208; 355/246

[58] Field of Search ..... 355/208, 246, 253, 260

[56] References Cited

U.S. PATENT DOCUMENTS 4,734,737 3/1988 Koichi ..... 355/206
4,758,861 7/1988 Nakamaru et al. ..... 355/246 X
4,977,428 12/1990 Sakakura et al. ..... 355/245
5,055,881 10/1991 Fukuchi ..... 355/260

*Primary Examiner*—Michael L. Gellner
*Assistant Examiner*—P. Stanzione
*Attorney, Agent, or Firm*—Oblon, Spivak, McClelland, Maier & Neustadt

[57] ABSTRACT

A developing device incorporated in an electrophotographic image forming apparatus using a dry developer. The device stores the developer in a hopper including an arcuate wall. Pressure sensors are mounted on the inner surface of the arcuate wall to determine the amount of developer existing in the hopper. A motor is controllably driven to change the rotation speed of an agitator or to change the period of intermittent rotation of the agitator in response to the outputs of the sensors. The rotation speed of the agitator may be changed in association with the load acting on the agitator. Further, while the motor is rotated at a constant speed, a gearing intervening between the motor and the agitator may have the gear ratio thereof changed to change the rotation speed of the agitator.

10 Claims, 8 Drawing Sheets

DEVELOPING DEVICE FOR AN IMAGE FORMING APPARATUS USING A DRY DEVELOPER

BACKGROUND OF THE INVENTION

The present invention relates to a developing device for a copier, facsimile transceiver, printer or similar electrophotographic image forming apparatus using a dry developer.

It is a common practice with a developing device for the above application to agitate a powdery developer, or toner, stored in a hopper by an agitator while conveying it to a developing roller. The agitator is mounted on one end of a rotary agitator shaft which protrudes to the outside of the hopper at the other end thereof. A motor is connected to the protruding end of the agitator shaft via a gearing to rotate the agitator shaft at a constant speed at all times, i.e., with no regard to the varying amount of toner in the hopper. This is not desirable for the following reasons. When a great amount of toner exists in the hopper, the agitator may be rotated at a relatively low speed since it is capable of conveying and supplying the toner to the developing roller efficiently. However, when the amount of toner remaining in the hopper is small, the rotation of the agitator has to be accelerated to compensate for the degration of conveying and supplying ability. It has been customary, however, to rotate the agitator at a constant speed, i.e., at a speed high enough to sufficiently convey the toner even when the toner remaining in the hopper is scarce. It follows that the agitator is undesirably rotated at a high speed when a great amount of toner exists in the hopper, supplying an excessive amount of toner to the developing roller. This brings about blocking, i.e., causes the developer to form blocks in the vicinity of the developing roller to thereby degrade the toner supply. Moreover, the toner fed in an excessive amount is apt to blow out through insufficiently sealed portions of the developing device. In addition, excessive stresses acting on the toner tend to deteriorate the toner.

SUMMARY OF THE INVENTION

It is, therefore, an object of the present invention to provide a developing device for an image forming apparatus capable of sufficiently transporting a dry developer to a developing roller even when the amount of developer remaining in a hopper is scarce.

It is another object of the present invention to provide a developing device for an image forming apparatus which saves power necessary for an agitator in a hopper to be rotated and frees a toner from deterioration.

In accordance with the present invention, a developing device having a developing roller for supplying a dry developer to an image carrier included in an image forming apparatus comprises a developer container containing the developer, an agitating member mounted on a rotary shaft in the developer container for agitating the developer, and a controller for controlling the amount of the developer to be fed from the developer container to the developing roller in associated with the amount of the developer present in the developer container.

Also, in accordance with the present invention, a developing device having a developing roller for supplying a dry developer to an image carrier including in an image forming apparatus comprises a developer container storing the developer, an agitating member rotatably disposed in the developer container for agitating the developer in the developer container, a sensor for sensing the amount of the developer at or around a position where a thin layer of the developer is formed on the developing roller, and a controller for causing the agitating member to start rotating only when the amount of developer sensed by the sensor is lower than a predetermined amount.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
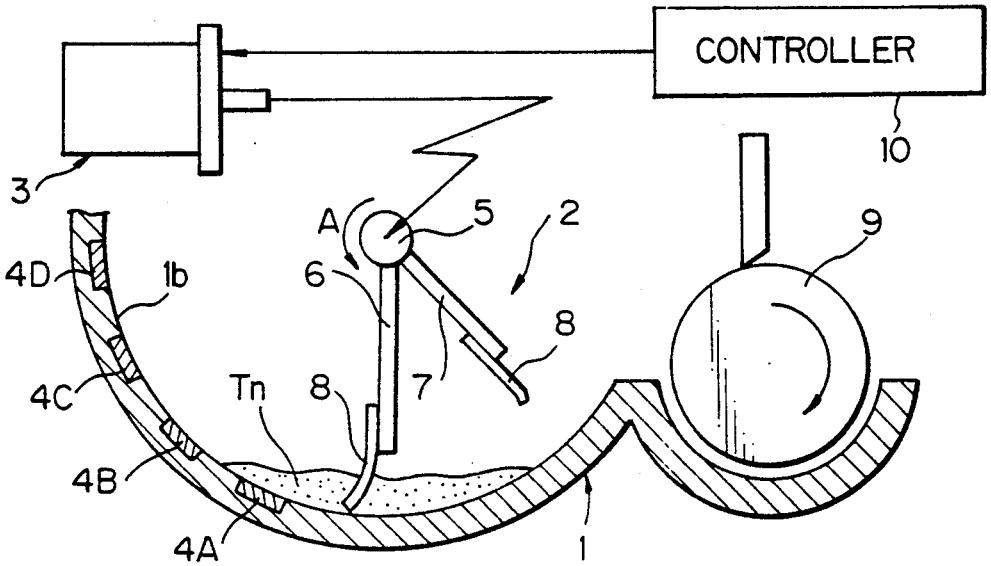
FIG. 1 is a section showing a developing device embodying the present invention.

Referring to FIG. 1 of the drawings, a developing device embodying the present invention is shown and includes a developer container in the form of a hopper 1. An agitator 2 is disposed in the hopper 1 and rotated by a motor 3 to agitate a toner, or developer. Tn while feeding it to a developing roller 9. The amount of toner Tn to be fed from the hopper 1 to the developing roller 9 is controlled in matching relation to the amount of toner existing in the hopper 1. For this purpose, the developing device has a plurality of sensors, e.g., pressure sensors 4A–4D responsive to the amount of toner Tn in the hopper 1, and a controller 10. While the sensors 4A–4D sense the varying amount of toner Tn in the hopper 1, the controller changes the rotation speed of the motor 3, i.e., the rotation speed of the agitator 2 in response to the outputs of the sensors 4A–4D. In the illustrative embodiment, the sensors 4A–4D and controller 10 constitute means for controlling the amount of toner to be conveyed from the hopper 1 to the developing roller 9 in association with the amount of toner in the hopper 1.

Figure 2:
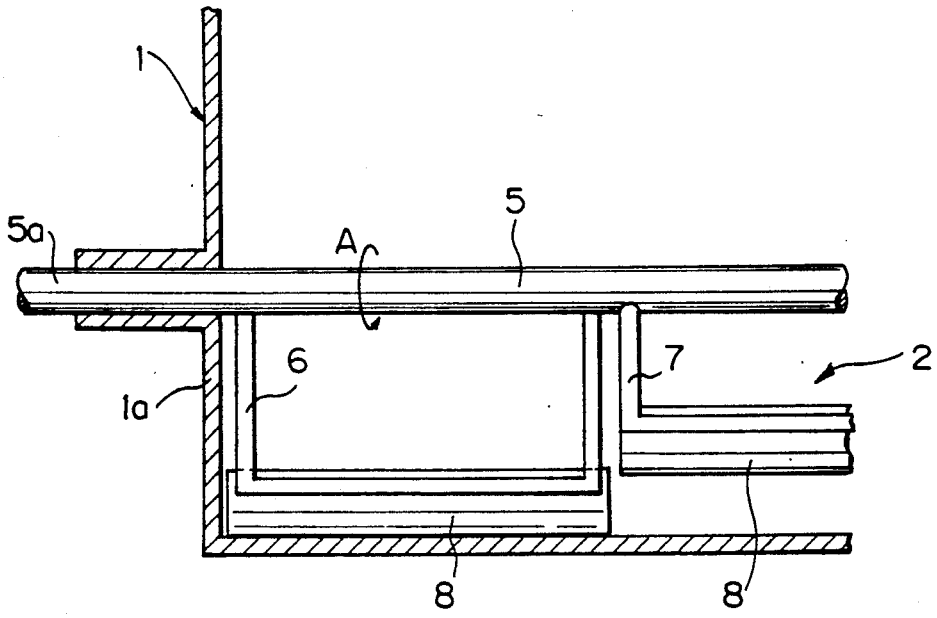
FIG. 2 is a vertical section along an agitator shaft included in the embodiment.

As shown in FIG. 2, the agitator 2 has a shaft 5, support members 6 and 7 each being affixed to the shaft 5 and extending in the axial direction of the shaft 5, and film members 8 each being affixed to the radially outer edge or free edge of one of the support members 6 and 7. The shaft 5 extends into the hopper 1 through a hopper side wall 1*a* from the outside and is rotatably supported by the side wall 1*a*. The support members 6 and 7 each has a particular length in the radial direction, as illustrated. The film members 8 are made of Mylar (trade name) or similar elastic material. As the shaft 5 is rotated in a direction indicated by an arrow A in the figures, the free edge of the film member 8 affixed to the support member 6 rotates together with the support member 7 while sliding on the inner surface 1*b* of the arcuate portion of the hopper 1. During such a movement, the film member 8 agitates the toner Tn stored in the hopper 1. The rotation of the motor 3 is transmitted to part 5*a* of the shaft 5 which protrduces from the hopper 1, as shown in FIG. 2.

As shown in FIG. 1, the four sensors 4A–4D are mounted at substantially equally spaced locations on the inner surface 1*b* of the hopper and sequentially arranged in this order from the bottom to the left-hand side. It should be noted that the number of sensors is not limited to four and may be increased or decreased, as desired. The amount of toner Tn existing in the hopper is determined in terms of the combination of the outputs of the sensors 4A–4D. Specifically, when the toner Tn is present between any one of the sensors 4A–4D and the film member 8, the toner Tn is pressed by the film member 8 to in turn press the sensor of interest, causing the sensor to sense the toner. The controller 10 determines that the developing device has run out of toner when the sensor 4A at the bottom, for example, does not sense the toner over a few seconds. Alternatively, the controller 10 may decide so by determining the outputs of the sensors 4A–4D when the film member 8 of the support member 6 sequentially arrives at the sensors 4A–4D and if none of the sensors 4A–4D sense the toner throughout some rotations of the film member 8.

The controller 10 is implemented as a microcomputer having a CPU (Central Processing Unit) having various deciding and processing functions, a ROM (Read Only Memory) storing programs and fixed data for controlling the developing device and other various sections constituting an image forming apparatus, not shown, a RAM (Random Access Memory) for storing processed data, and an I/O (Input/Output) circuit.

The illustrative embodiment determines the amount of toner on the basis of the combination of the outputs of four sensors 4A–4D and feeds it back to the motor 3 to thereby change the rotation of the agitator 2. When use is made of four sensors, the agitator 2 can be selectively rotated at one of five different speeds in total (when all the sensors 4A–4D are turned on, the controller 10 determines that the hopper 1 is full). Such sensors may be located at any positions on the inner surface 1*b* of the arcuate portion of the hopper 1, except for the dead space where only a small amount of toner remains on the bottom of the hopper 1, so long as they are capable of sensing a change in the amount of the toner. If desired, the sensors 4A–4D may be constituted by ultrasonic sensors.

Referring to FIGS. 3–10, an alternative embodiment of the present invention will be described which changes the rotation speed of the agitator in matching relation to the load acting on the shaft of the agitator. In the figures, the same parts and structural elements are designated by like reference numerals, and redundant description will be avoided for simplicity.

Figure 3:
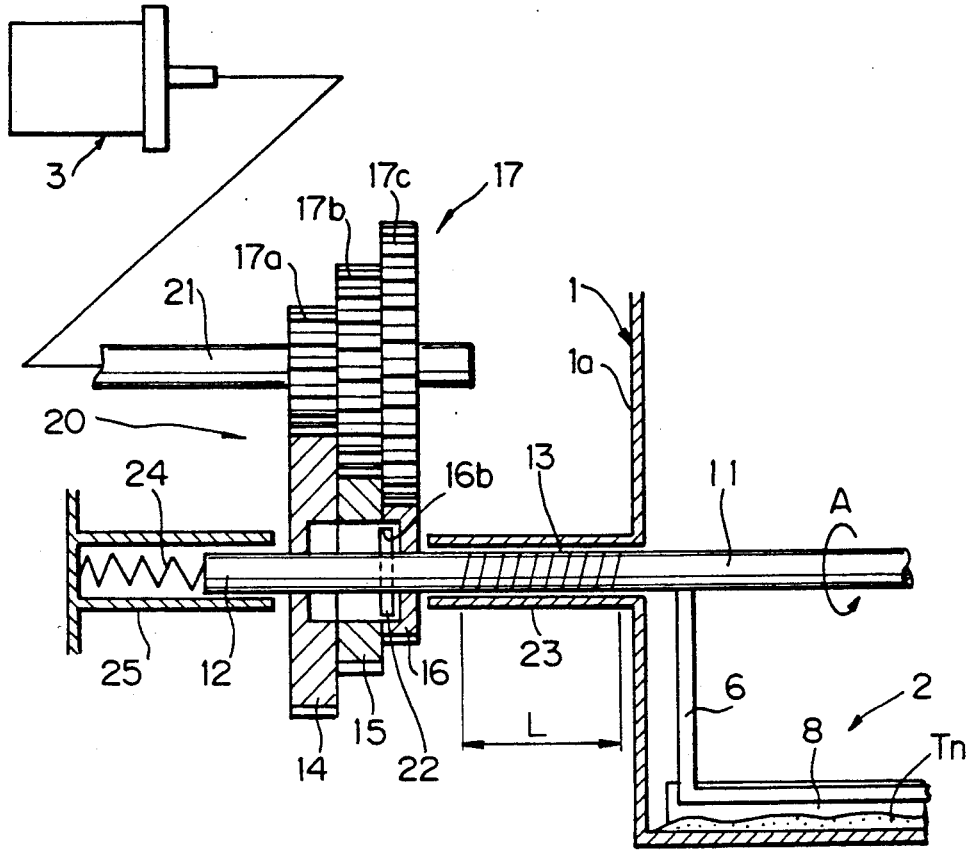
FIG. 3 is a section showing an alternative embodiment of the present invention.

As shown in FIG. 3, the support member 6 supporting the film member 8 is mounted on a shaft 11. The rotation speed of the agitator 2 is changed in association with the load acting on the shaft 11. Specifically, while motor 3 is rotated at a constant speed, a gearing 20 intervening between the motor 3 and the shaft 11 has the gear ratio thereof changed to change the rotation speed of the agitator 2. The gearing 20 includes a transmission shaft 12 which is connected to the shaft 11 by a number of couplings 13. Three gears 14, 15 and 16 each having a particular outside diameter are mounted on the transmission shaft 12 and rotatable independently of one another. A pawl in the form of a pin 22 is affixed to the transmission shaft 12. The gears 14–16 are each engageable with the pin 22. A drive gear 17 is fixedly mounted on a drive shaft 21 which is driven by the motor 3. The drive gear 17 has three gear portions 17*a*, 17*b* and 17*c* corresponding to the gears 14, 15 and 16, respectively. The gear ratio of the gearing 20 is determined by intermeshing ones of the gears 14–16 an 17*a*–17*c*. Specifically, the rotation of the motor 3 is imparted to the drive gear 21 via the drive shaft 21. The drive shaft 21 in turn transmits the rotation thereof to one of the gears 14–16 which is in mesh with one of the gear portions 17*a*–17*c*. The resulting rotation of one of the gears 14–16 is transmitted to the transmission shaft 12 via the pawl 22. Then, the transmission shaft 12 rotates the agitator shaft 11 and, therefore, the agitator 2 in a direction indicated by an arrow in FIG. 3 via the couplings 13.

Figure 4:
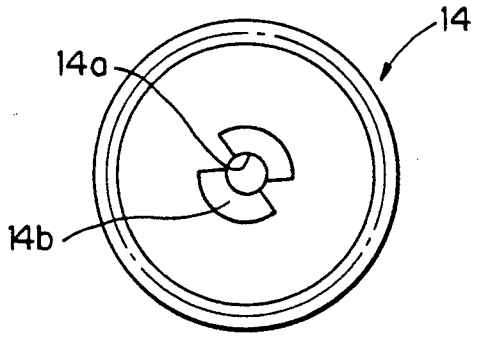
FIGS. 4–6 are front views showing the configurations of gears included in a gearing shown in FIG. 3.
Figure 5:
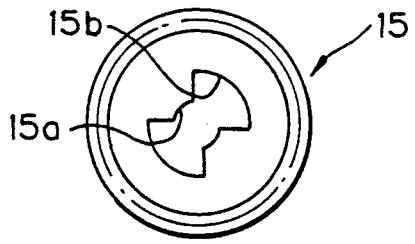
Figure 6:
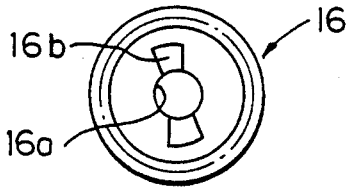

As shown in FIGS. 4–6, the gears 14, 15 and 16 have respectively through holes 14*a*, 15*a* and 16*a* through which the transmission shaft 12 extends. Receses 14*b* and 16*b* extend radially outward from the through holes 14*a* and 16*a*, respectively. A hole 15*b* is formed through the gear 15 and communicated to the through hole 15*a*. As shown in FIG. 3, the pawl 22 is fitted in the transmission shaft 12 to extend in the radial direction of the shaft 12. The pawl 22 protrudes from the transmission shaft 12 at both ends thereof to the same distance and are so dimensioned as to be smoothly received in any one of the recesses 14*b* and 16*b* of the gears 14 and 16 and the hole 15*b* of the gear 15.

The agitator shaft 11, couplings 13 and transmission shaft 12 are rotatably received in a tubular bearing portion 23 extending from the hopper side wall 1*a* to the left, as viewed in FIG. 3, and a bearing tube 25 which is aligned with the bearing portion 23. A coiled compression spring 24 is loaded between the left end of the transmission shaft 12, as viewed in FIG. 3, and the verticall wall of the bearing tube 25. In an unloaded condition, the transmission shaft 12 is urged toward and connected to the couplings 13 by the compression spring 24 while reducing the overall length L of the couplings 13 to minimum one. In such a condition, the pawl 22 mates with the recess 16*b* of the gear 16 having the smallest outside diameter, as shown in FIG. 3 (see FIG. 6 also).

As shown in FIG. 7–10, the couplings 13 are each implemented by a metallic disk having a certain thickness and are provided with inclined surfaces 13*a*–13*d* at both sides thereof. Adjoining ones of the inclined surfaces 13–13*d* are inclined relative to each other by an angle $\theta$. The nearby couplings 13 contact each other at their inclined surfaces 13c and 13a and inclined surfaces 13d and 13c. Regarding the coupling 13 adjoining the agitator shaft 11, the inclined surfaces 13a and 13b contact complementary inclined surfaces formed on the left end of the agitator shaft 11. Likewise, the inclined surfaces 13c and 13d of the coupling adjoining the transmission shaft 12 contact complementary inclined surfaces formed on the right end of the shaft 12. With this configuration, the couplings 13 sequentially transmit the rotation of the transmission shaft 12 to the agitator shaft 11 due to friction thereof.

Assume that the transmission shaft 12 is urged to the left in FIG. 3 by the compression spring 24 to a position where the pawl 22 mates with the recess 12b of the gear 16. Then, as the motor 3 is rotated, the rotation is transmitted to the gear 16 via the gear portion 17c of the drive gear 17. The resulting rotation of the gear 16 is imparted to the transmission shaft 12 via the pawl 22. As a result, the transmission shaft 12 rotates the agitator shaft 11 and, therefore, the agitator 2 in the direction A via the couplings 13 whose length L is minimum. At this instant, the agitator 2 is rotated at the highest speed due to the diameter of the gear 16. When a great amount of toner Tn exists in the hopper 1, a heavy load acts on the agitator 2 and tends to cause the couplings 13 to expand in the thrust direction (in the right-and-left direction in FIG. 3). Consequently, the pawl 22 affixed to the transmission shaft 12 is shifted to the left, as viewed in FIG. 3, to a position where the force of the couplings 13 tending to expand balances with the force of the compression spring 24 which counteracts the force of the couplings 13. If the pawl 22 mates with the gear intermediate gear 15, the gear 15 meshes with the gear portion 17b of the drive gear 17 and causes the agitator 2 to rotate at a medium speed. If the pawl 22 is shifted further to the left to mate with the gear 14, the gear 14 meshes with the gear portion 17a to rotate the agitator 2 at a low speed.

As the amount of toner Tn in the hopper 1 and, therefore, the load acting on the agitator 2 sequentially decreases, the force tending to cause the couplings 13 to expand decreases. As a result, the pawl 22 is sequentially shifted to the left in FIG. 3, changing the intermeshing gears. As a result, the rotation speed of the agitator 2 is automatically increased.

As stated above, the agitator 2 is rotatable at any one of three different speeds matching the amount of toner Tn existing in the hopper 1. Specifically, the agitator 2 may be rotated at a speed matching the maximum amount of toner Tn in the hopper 1 when the gear 14 and the gear portion 17a mesh, rotated at a speed matching the minimum amount of toner nearly ending when the gear 16 and the gear portion 17c mesh, and at a speed matching the medium amount of toner when the gear 15 and the gear portion 17b mesh.

Further, this embodiment saves power since the load acting on the motor 3 decreases when the amount of toner Tn in the hopper 1 is small. In addition, since the product of torque and rotation speed is constant in this embodiment, priority can be given to either of them, i.e., it is not necessary to set either of them at the maximum value.

Figure 7:
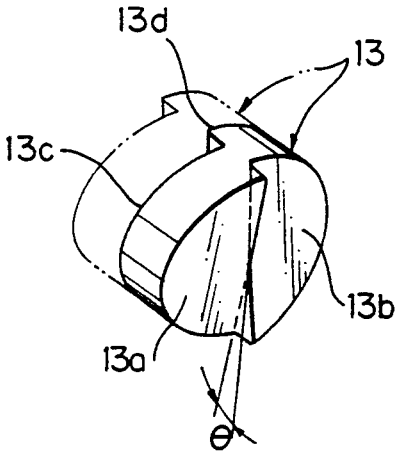
FIG. 7 is a perspective view of one of couplings included in the embodiment of FIG. 3.
Figure 8:
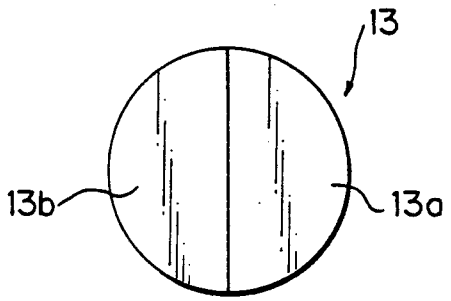
FIGS. 8–10 show the coupling of FIG. 7 in a plan view, front view, and side elevation, respectively.
Figure 9:
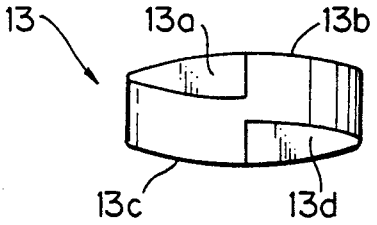
Figure 10:
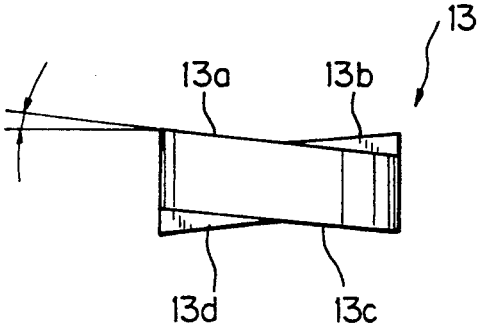

To prevent the couplings 13 from idling on one another, the angle $\theta$ of the inclined surfaces 13a–13d shown in FIGS. 7 and 10, the coefficient friction $\mu$ of the inclined surfaces, the number of couplings 13, and the spring constant and length of the compression spring 24, FIG. 3, are adequately selected. Then, the couplings 13 may also play the role of a torque limiter.

Figure 11:
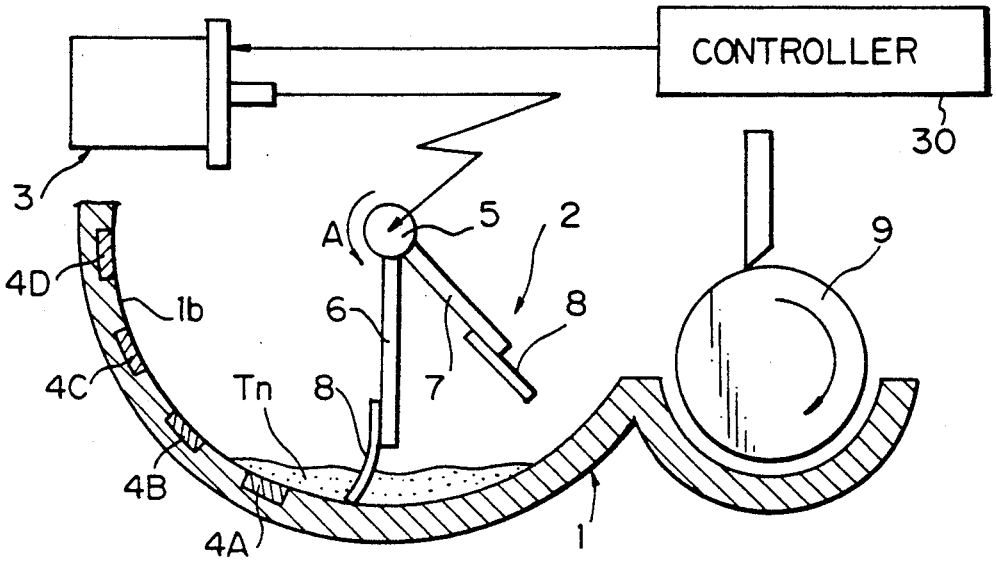
FIG. 11 is a section showing another alternative embodiment of the present invention.

Referring to FIG. 11, another alternative embodiment of the present invention is shown which rotates the agitator intermittently and changes the period of intermittent rotation on the basis of the amount of toner present in the hopper. In FIG. 11, the same parts and structural elements as those shown in FIG. 1 are designated by like reference numerals, and redundant description will be avoided for simplicity. As shown, the developing device has a controller 30 in addition to the sensors, e.g., pressure sensors 4A–4D responsive to the amount of toner Tn in the hopper 1. The controller 30 controls the period of intermittent rotation o the agitator 2 in matching relation to the amount of toner sensed by the sensors 4A–4D. In the embodiment, the sensors 4A–4D and controller 30 constitute the means for controlling the amount of toner to be fed from the hopper 1 to the developing roller on the basis of the amount of toner in the hopper 1.

Figure 12:
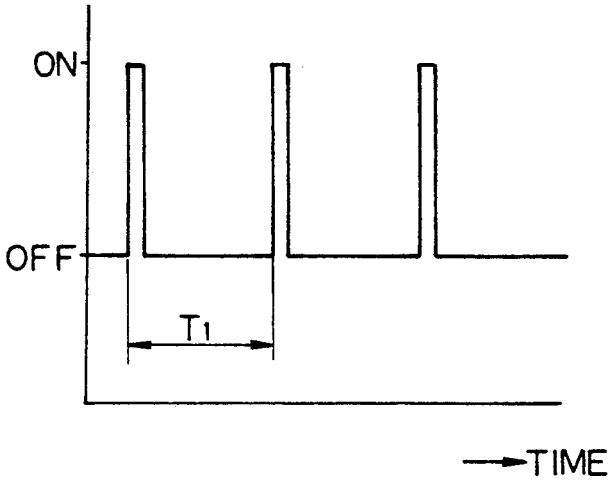
FIGS. 12–15 are charts each showing a particular pulse waveform for rotating an agitator included in the embodiment of FIG. 11 intermittently.

The controller 30 is implemented as a microcomputer having the various circuit components having been mentioned in relation to the controller 10 of FIG. 1. Based on the combination of the outputs of the sensors 4A–4D, the controller 30 controls the rotation of the motor 3 to change the period of intermittent rotation of the agitator 2. As a result, the toner Tn is fed in a controlled amount from the hopper 1 to the developing roller 9. Specifically, when the hopper 1 is full of toner, i.e., when all the sensors 4A–4D are turned on, the controller 30 causes the agitator 2 to rotate intermittently at a comparatively long period T1 via the motor 3, as shown in FIG. 12. As a result, the frequency of rotation of the agitator 2 is reduced to eliminate blocking ascribable to the excessive supply of toner and the deterioration of toner ascribable to stresses.

Figure 13:
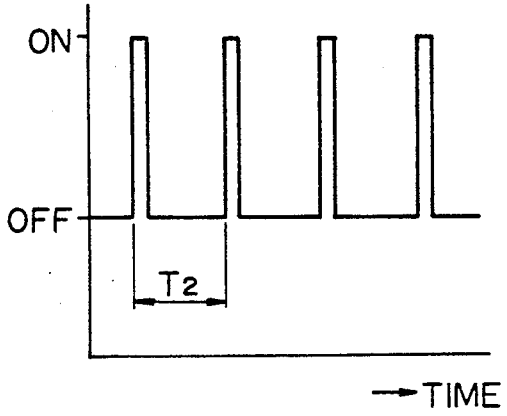
Figure 14:
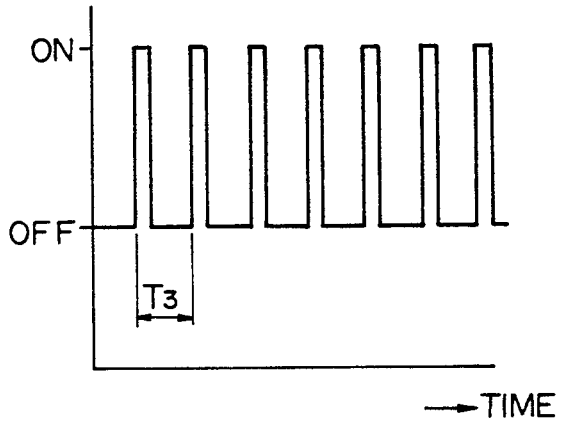
Figure 15:
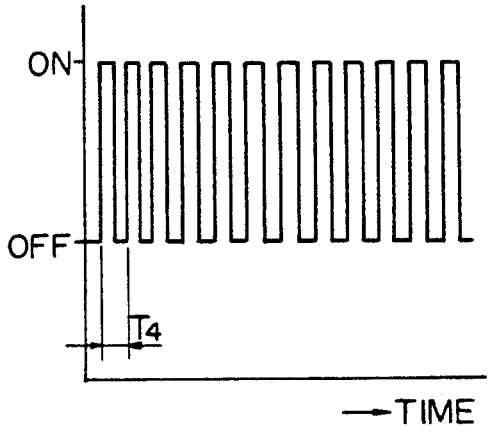

As shown in FIG. 13, when the sensors 4A, 4B and 4C are turned on, the agitator 2 is rotated intermittently at a period T2 which is slightly shorter than the period T1, FIG. 12. As shown in FIG. 14, when the sensors 4A and 4B are turned on, the intermittent rotation of the agitator 2 is effected at a period T3 which is even shorter than the period T2. Further, when only the sensor 4A is turned on, the agitator 2 is rotated at an extremely short period T4 shown in FIG. 14, i.e., almost continuously. Therefore, when the amount of toner Tn remaining in the hopper 1 is small, the agitator 2 is rotated intermittently at a short period so as to surely transport it to the developing roller 9. When much toner exists in the hopper 1, the motor 3 is driven intermittently at a longer period and, therefore, remains in a halt over a longer period of time, thereby contributing to power saving.

In this embodiment, the motor 3 is rotated at a constant speed, i.e., the period of time necessary for the agitator 2 to comple one rotation is constant. A relation between the amount of toner remaining in the hopper 1 and the period T of intermittent rotation may be determined by determining a reltion between the remaining amount of toner and the conveying ability per period beforehand by experiments. If desired, the agitator 2 may be continuously rotated when only the sensor 4A is turned on.

Figure 16:
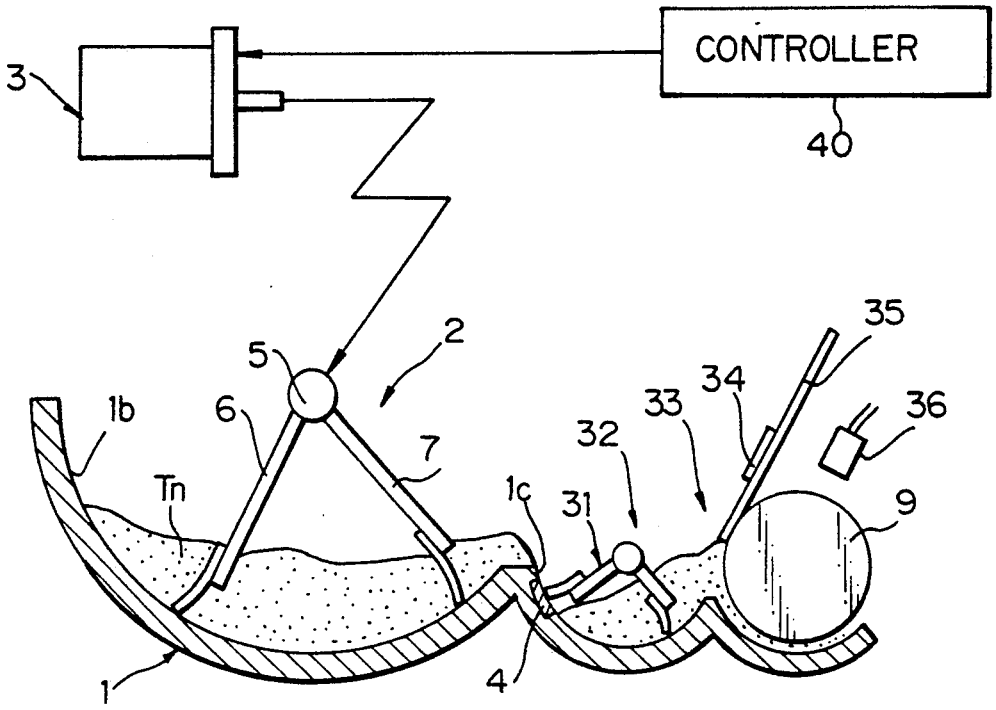
FIG. 16 is a section showing other alternative embodiments of the present invention.

Referring to FIG. 16, another alternative embodiment of the present invention will be described. In FIG. 16, the same parts and structural elements as those shown in FIG. 1 are designated by like reference numerals, and redundant description will be avoided for simplicity. Briefly, this embodiment locates a sensor responsive to the amount of toner in a position other than the position where the agitator is located.

Specifically, as shown in FIG. 16, the amount of toner Tn in the hopper 1 can be sensed even when a single sensor 4 similar to the sensors 4A–4C, FIG. 1, is mounted on the wall 1*c* of a toner supply section in which a toner supply member 31 is rotatably disposed. The position of the sensor 4 is slightly above the bottom of the wall 1*c*. In light of this, the embodiment uses a controller 40 (implemented as a microcomputer) which causes the agitator 2 to rotate only when the amount of toner Tn being sensed by the sensor 4 decreases beyond a predetermined value. Only when the amount of toner contacting the sensor 4 decreases to a toner near end level, the controller 40 causes the motor 3 to start rotating the agitator 2 in response to the output of the sensor 4. Such a configuration is successful in maintaining a constant amount of toner in the toner supply section 32 at all times and, therefore, in surely supplying a constant amount of toner to the developing roller 9.

As also shown in FIG. 16, a blade 35 is located at a position 33 for regulating the thickness of the toner deposited on the developing roller 9. The blade 35 is held in contact with the surface of the developing roller. A deflection gauge 34 may be adhered or otherwise affixed to the doctor blade 35. Then, the deflection of the gauge 34 will change with the thickness of the toner deposited on the developing roller 9, indicating the amount of toner. In such a case, only when the amount of toner being sensed by the gauge 34 decreases to below a reference amount, the motor 3 starts rotating the agitator 2. More specifically, the deflection of the doctor blade 35 is measured beforehand without forming any toner layer on the surface of the developing roller 9 and is used as a reference value (for resetting). Also, a relation between the thickness of the toner layer and the deflection of the blade 35 is determined by, for example, actual measurement. Only when the thickness of the toner layer formed on the developing roller 9 is reduced to below a predetermined reference thickness which needs toner supply, the motor 3 is driven to rotate the agitator 2 to supply the toner to the neighborhood of the position 33. Then, the toner thickness will be restored to the reference thickness. Hence, even when the amount of toner remaining in the hopper 1 is almost at the toner end level, the toner on the surface of the developing roller 9 can be maintained in a constant thickness.

Moreover, as shown in FIG. 16, the sensor responsive to the amount of toner may be implemented as a toner concentration sensor 36 which senses the concentration of toner on the surface of the developing roller 9. Then, an arrangement will be made such that the motor 3 drives the agitator 2 only when the amount of toner sensed by the sensor 36 is lower than a reference valve. This embodiment does not need an extra sensor responsive to the amount of toner and, therefore, reduces the cost of the developing device.

In the embodiments described above with reference to FIG. 16, the motor 3 and, therefore, the agitator 2 starts rotating at the instant when the amount of toner sensed by the sensor 4, deflection gauge 34 or toner concentration sensor 36 is lower than a reference value. Alternatively, the motor 3 may be usually rotated at an extremely low speed and rotated at an ordinary or higher speed when the sensor 4, 34 or 36 senses an amount of toner lower than the reference value.

In the embodiment shown in FIG. 1, assuming that the sensors 4A–4D are pressure sensors, they sense the toner by being pressed by the toner due to the rotation of the agitator 2. Therefore, the agitator 2 in such an arrangement has to be constantly rotated even when the hopper 1 is almost full. By contrast, when the sensor implemented as the deflection gauge 34 or the concentration sensor 36 is located at a position other than the position where the agitator 2 is located, i.e., at the thin layer forming position or the neighborhood thereof, the agitator 2 does not halve to be rotated until the amount of toner decreases beyond a reference value. This further enhances the power saving effect.

Figure 17:
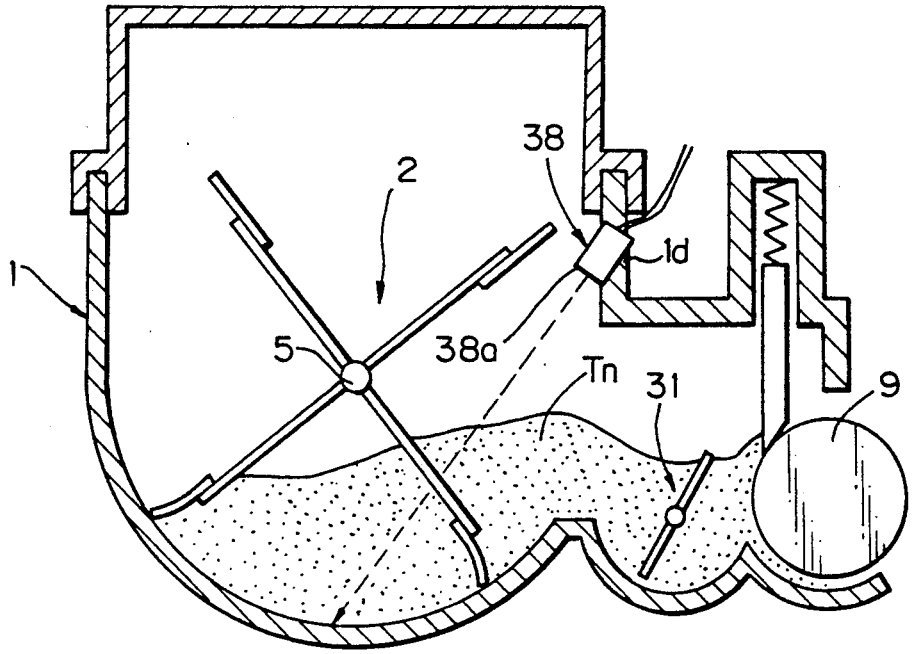
FIG. 17 is a section showing another alternative embodiment of the present invention.
Figure 18:
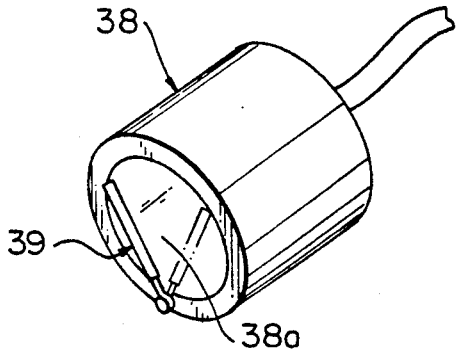
FIG. 18 is a perspective view showing a specific construction of a non-contact type sensor included in the embodiment of FIG. 17.

FIG. 17 shows another alternative embodiment of the present invention which senses the amount of hopper existing in the hopper 1 by using a non-contact type method. As shown, a non-contact type sensor 38 is mounted on a wall 1*d* which forms upper part of the hopper 1 in order to sense the amount of toner Tn in terms of height. The output of the sensor 38 may be used to control the rotation speed or the period of intermittent rotation of the agitator 2 or to start rotating the toner only when an amount of toner less than a reference amount is sensed. The sensor 38 may be constituted by a conventional ultrasonic displacement sensor, as shown in FIG. 18, or a laser type displacement sensor, not shown. The ultrasonic displacement sensor 38 emits an ultrasonic pulse signal toward an object from the sensing surface 38*a* thereof and then receives a reflection from the object, determining the distance between the sensor 38 and the object in terms of the interval between the emission and the arrival of the reflection. Since the toner is powdery, the amount of toner determined by the sensor 38 while the toner is agitated by the agitator 2 may differ from the actual amount. Preferably, therefore, the measurement should be continued over a predetermined period of time in order to determine the amount of toner after the top of the toner has become substanially horizontal. If desired, the sensor 38 may sense the amount of toner when the agitator 2 is in a halt, i.e., when the top of the toner is horizontal.

Figure 19:
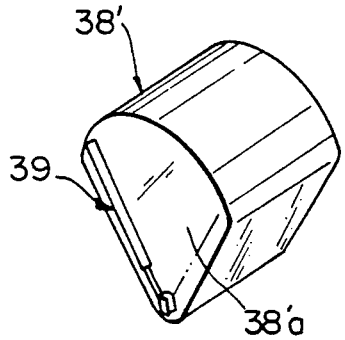
FIG. 19 is a view similar to FIG. 18, showing another specific construction of the sensor.
Figure 20:
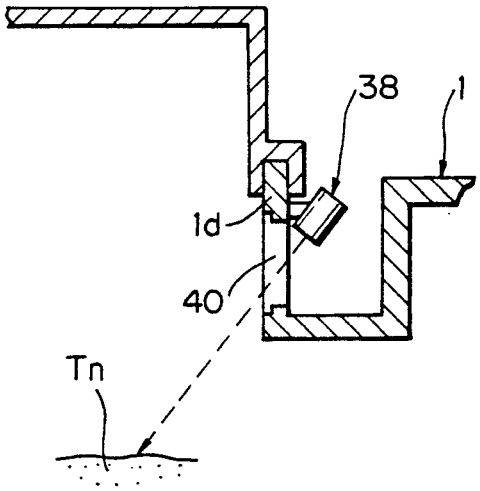
FIG. 20 is a section showing an arrangement wherein the sensor of FIG. 18 is located at the outside of a hopper.

When the sensor 38 is located such that the sensing surface 38*a* thereof faces the inside of the hopper 1 where the toner Tn flies, it is preferable to provide it with some implementation for enhancing accurate measurement. FIG. 18 shows a wiper 39 which is a specific form of such an implementation. The wiper 39 wipes the transparent sensing surface of the sensor 38*a* to maintain it clean at all times. In such a case, as shown in FIG. 19, the sensor 38 may have a sensing surface 38*a'* whose shape matches the wiping area of the wiper 39. This will fully prevent the toner from accumulating on the sensing surface 38*a'*. Further, as shown in FIG. 20, the sensor 38 may be located at the outside of the wall 1*d* of the hopper 1 while part of the wall 1*d* positioned on the propagation path of, for example, an ultrasonic wave (indicated by a dashed line) may be implemented as a transparent window 40 made of a material which sparingly collects toner. The configuration of FIG. 20 eliminates the need for a wiper or similar cleaning device.

In summary, it will be seen that the present invention provides a developing device which, even when a great amount of toner exists in a hopper thereof, eliminates blocking of the toner and the blow-out thereof via insufficiently sealed portions which are ascribable to excessive toner supply. At the same time, the device frees the toner from deterioration due to stresses. Even when the amount of toner remaining in the hopper is small, the device surely supplies it to a developing roller. In addition, the device needs only a small motor torque for agitating a developer and, therefore, saves power.

Various modifications will become possible for those skilled in the art after receiving the teachings of the present disclosure without departing from the scope thereof.

What is claimed is:

1. A developing device having a developing roller for supplying a dry developer to an image carrier included in an image forming apparatus, comprising:

a developing roller;

a developer container containing the developer adjacent to said developing roller for supplying developer to said developing roller;

an agitating member mounted on a rotary shaft in said developer container for agitating the developer wherein agitating movement of said agitating member causes developer to be supplied to said developing roller;

control means for controlling the amount of the developer to be fed from said developer container to said developing roller in association with the amount of said developer present in said developer container;

said control means including a coupling arrangement connected to said rotary shaft which automatically changes a driving relationship of said rotary shaft with respect to a plurality of gears such that a change in load upon said rotary shaft causes said coupling arrangement to establish a driving engagement with a different gear of said plurality of gears.

2. The developing device of claim 1, wherein said coupling arrangement includes an expansion coupling disposed between a transmission shaft and said rotary shaft of said agitating member.

3. A developing device having a developing roller for supplying a dry developer to an image carrier included in an image forming apparatus, comprising:

a developer container containing the developer;

an agitating member mounted on a rotary shaft in said developer container for agitating the developer; and control means for controlling the amount of the developer to be fed from said developer container to said developing roller in association with the amount of said developer present in said developer container, wherein said control means comprises:

sensing means for sensing the amount of the developer in said developer container said sensing means producing at least three outputs corresponding to at least three different amounts of developer in said developer container; and rotation speed changing means for changing the rotation speed of said agitating member in response to outputs of said sensing means corresponding to the amount of the developer sensed by said sensing means;

said developing device further including a motor for driving said agitating member in a rotary motion by said rotary shaft; and a gearing for transmitting the rotation of said motor to said rotary shaft.

4. A device as claimed in claim 2, wherein said rotation speed changing means comprises a gear ratio changing means for changing the gear ratio of said gearing.

5. A developing device having a developing roller for supplying a dry developer to an image carrier included in an image forming apparatus, comprising:

a developer container storing the developer;

an agitating member rotatably disposed in said developer container for agitating the developer in said developer container;

sensing means for sensing the amount of the developer at or around a position where a thin layer of the developer is formed on said developing roller; and control means for causing said agitating member to start rotating only when the amount of developer sensed by said sensing means is lower than a predetermined amount;

wherein said sensing means comprises a concentration sensor for sensing the concentration of the developer deposited on the surface of said developing roller.

6. A developing device having a developing roller for supplying a dry developer to an image carrier included in an image forming apparatus, comprising:

a developer container storing the developer;

an agitating member rotatably disposed in said developer container for agitating the developer in said developer container;

sensing means for sensing the amount of the developer at or around a position where a thin layer of the developer is formed on said developing roller; and control means for causing said agitating member to start rotating only when the amount of developer sensed by said sensing means is lower than a predetermined amount;

wherein said sensing means comprises a deflection gauge affixed to a blade which contacts the surface of said developing roller for regulating the thickness of the developer.

7. A developing device having a developing roller for supplying a dry developer to an image carrier included in an image forming apparatus, comprising:

a developing roller;

a developer container for containing developer;

an agitating member mounted in said developer container for agitating the developer;

sensing means for sensing varying amounts of developer in said container such that the presence and amount of developer in said container can be determined, wherein said sensing means includes a plurality of sensors producing a plurality of outputs corresponding to varying amounts of developer in said container; and control means for receiving said plurality of outputs and in response to said plurality of outputs for controlling the amount of developer to be fed from said developer container to said developing roller in association with the amount of said developer present in said developer container as determined by said plurality of outputs, said control means controlling movement of said agitator member based upon said plurality of outputs such that a greater amount of movement of said agitator member is provided for lower amounts of developer.

8. A developing device having a developing roller for supplying a dry developer to an image carrier included in an image forming apparatus, comprising:

a developer container for containing developer;

a developer roller at least partially disposed within said developer container;

an agitating member mounted in said developer container immediately upstream of said developer roller for agitating the developer; and sensing means for sensing varying levels of toner in said developer at a location adjacent said agitating member;

control means controlling said agitating member for controlling the amount of the developer to be fed to said developing roller in association with the amount of said developer sensed by said sensing means.

9. The developing device of claim 8, wherein said control means controls the agitating member to move intermittently, and wherein the amount of movement of said agitating member is controlled by said control means by varying frequency of intermittent movement.

10. The developing device of claim 8, wherein said control means controls the amount of movement of the agitating member by varying movement speed of said agitating member such that said agitating member moves at a plurality of speeds greater than zero, wherein a higher speed of movement is imparted to the agitating member for lower amounts of developer present in the developer container and a lower speed of movement is imparted to the agitating member for greater amounts of developer present in said developer container.

* * * * *